US007028407B2

(12) United States Patent
Ehrlich et al.

(10) Patent No.: US 7,028,407 B2
(45) Date of Patent: Apr. 18, 2006

(54) EXTENDABLE HANDLE SHAVING SYSTEM

(76) Inventors: Ronald William Ehrlich, 1214 E. Long Valley Dr., Palatine, IL (US) 60074; Karen A. Wolak, 4607 Burnham Dr., Hoffman Estates, IL (US) 60195

( * ) Notice: Subject to any disclaimer, the term of this patent is extended or adjusted under 35 U.S.C. 154(b) by 120 days.

(21) Appl. No.: 10/828,603

(22) Filed: Apr. 21, 2004

(65) Prior Publication Data

US 2004/0194325 A1 Oct. 7, 2004

Related U.S. Application Data

(63) Continuation-in-part of application No. 10/142,180, filed on May 9, 2002, now abandoned.

(51) Int. Cl.
*B26B 21/40* (2006.01)

(52) U.S. Cl. ..... 30/526; 30/537; 132/200

(58) Field of Classification Search ..... 30/526, 30/537, 528, 531, 532, 538; 16/900, 901, 16/110.1, 111.1, 429; D28/44, 44.1, 45–48; 132/200

See application file for complete search history.

(56) References Cited

U.S. PATENT DOCUMENTS 4,905,372 A * 3/1990 Willis ..... 30/526
5,167,069 A 12/1992 Quinn
5,193,528 A * 3/1993 Iwamoto et al. ..... 16/429
5,704,127 A 1/1998 Cordio
5,911,480 A 6/1999 Morgan
6,189,222 B1 * 2/2001 Doyle ..... 30/526
6,266,888 B1 7/2001 Zowaski
2003/0177648 A1 * 9/2003 Zeiter ..... 30/526

FOREIGN PATENT DOCUMENTS

GB 2306373 5/1997

* cited by examiner

*Primary Examiner*—Stephen Choi
(74) *Attorney, Agent, or Firm*—Meroni & Meroni, P.C.; Charles F. Meroni, Jr.; Christopher J. Scott

(57) ABSTRACT

The present invention provides an extendable handle shaving system comprising an extendable handle assembly and a select shaving blade attachment. The assembly comprises a hand grip portion and a connecting rod. The connecting rod comprises a handle-engaging first rod end, a blade-receiving second rod end, and an S-shaped angular bend intermediate the first rod end and the second rod end. A length-adjusting button is cooperatively associated with the connecting rod for adjusting the effective length of the connecting rod. The select shaving blade attachment may be selected from a disposable straight razor blade assembly and an electric razor head assembly. The shaving system may thus further comprise a power source-recharging base and the extendable handle assembly may comprise a rechargeable power source and electric circuitry. The rechargeable power source and electric circuitry function to selectively and electrically operate the electric razor head assembly.

21 Claims, 1 Drawing Sheet

EXTENDABLE HANDLE SHAVING SYSTEM

PRIOR APPLICATION

This is a Continuation-in-Part patent application of U.S. patent application Ser. No. 10/142,180, filed May 9, 2002 now abandoned.

BACKGROUND OF THE INVENTION

1. Field of the Invention

The present invention relates to a shaving system for enabling users thereof to shave hard to reach body areas. More particularly, the present invention relates to an improved extendable handle shaving system and methods of using such shaving system for shaving hard to reach body areas, such as one's back.

2. Description of the Prior Art

Although shaving assemblies and shaving apparatuses on the marketplace are commonly used to shave various parts of the body, these shaving apparatuses are typically designed for easy to reach areas of the body. In other words, existing marketplace shaving apparatuses are not designed to enable users thereof to shave hard to reach areas of the body, particularly one's own back. For example, existing shavers may be of insufficient length or of generally linear handle design and therefore do not properly align with the contour of the body. Consequently, the existing marketplace shaving apparatuses are typically not well designed to enable a user to shave one's own back and other hard to reach body areas. It is contemplated that if the shaving apparatuses were to be equipped an extendable handle, hard to reach body areas may be made more easy to reach. Prior art patent disclosures do teach a number of shaving apparatuses that comprise extendable handle type structure for enabling a user to more easily reach otherwise hard to reach body areas. Some of the more pertinent prior art relating to this concept is described hereinafter.

U.S. Pat. No. 6,266,888 ('888 Patent), which issued to Zowaski, discloses a Reaching Razor. The '888 Patent teaches a reaching razor comprising a head portion, a handle portion, and an elongated, flexible neck having a head attachment end opposite a handle attachment end. The head portion is affixed to the head attachment end and the handle is attached to the handle attachment end so as to provide the user with the ability to articulate the head attachment end in relation to the handle attachment end fully about the lateral centerline of the handle.

U.S. Pat. No. 5,167,069 ('069 Patent), which issued to Quinn, discloses a Razor Reach. The '069 Patent teaches a razor shaving apparatus comprising a telescopically extendable and retractable body with a manual handle at one end and a pivoting razor shaving system at its opposite end. Further, the '069 Patent teaches a shaving apparatus that comprises a soap or lotion applicator detachably secured to the razor shaving system.

U.S. Pat. No. 5,911,480 ('480 Patent), which issued to Morgan, discloses a Razor Having Extendable Handle With Adjustable Portions. The '480 Patent teaches a razor having an extendable, telescoping handle wherein the handle has at least one telescoping segment which is slidingly movable and frictionally securable to a number of extendable positions. The handle is preferably flexible and resilient to allow the razor blade to conform closely to the contours of the body portion being shaved. The telescoping handle can be removed and secured to a variety of razors, such as disposable razors.

U.S. Pat. No. 5,704,127 ('127 Patent), which issued to Cordio, discloses a Concave, Convex Safety Razor. The '127 Patent teaches a safety razor comprising a safety razor blade housing having a concave cutting surface on one end, a convex cutting surface on the other end, and a removable and rotatable apparatus disposed on the housing. An elongated handle cooperates with the removable and rotatable apparatus disposed on the housing permitting rotation of the safety razor blade housing and removal and replacement thereof. A hollow extensible handle is adapted to be affixed to the safety razor handle and is capable of extending the length thereof.

United Kingdom Patent No. 2,306,373 ('373 Patent), which issued to Pollitt, discloses a Razor. The '373 Patent teaches a razor comprising a handle and a head with at least one razor blade. The handle comprises detachable chambers, which chambers housing soap material, gel or cream. The handle may be squeezable to cause the material to leave the handle. The soap material may be in sachets detachably connected to the razor by frangible means.

It will thus be seen from a review of these patent disclosures as well as from a consideration of the prior art razor systems generally known to exist that the prior art does not teach an electric shaving system for enabling users thereof to shave hard to reach body areas, which shaving system comprises, in combination, an extendable handle assembly comprising a rigid, substantially S-shaped angular bend at the shaving end, a length-adjusting button cooperatively associated with the extendable handle assembly for selectively adjusting the length of the shaving apparatus, and an electric shaving head attachment attachable to the extendable handle assembly adjacent the S-shaped angular bend. The prior art thus perceives a need for a shaving system that comprises an extendable handle assembly comprising a rigid, substantially S-shaped angular bend at the shaving end, a length-adjusting button cooperatively associated with the extendable handle assembly for selectively adjusting the length of the shaving apparatus, and an electric shaving head attachment attachable to the extendable handle assembly adjacent the S-shaped angular bend.

SUMMARY OF THE INVENTION

The purpose and advantages of the present invention will be set forth in and apparent from the description that follows, as well as will be learned by practice of the invention. Additional advantages of the invention will be realized and attained by the apparatuses and methods particularly pointed out in the written description and claims hereof, as well as from the appended drawings.

To achieve these and other advantages, as embodied and broadly described, the present invention teaches an extendable handle shaving system comprising an extendable handle assembly, which assembly essentially comprises a hand grip portion and a connecting rod. The hand grip portion comprises a longitudinally aligned, substantially linear rod-receiving first handle end and a ringed, hand-engaging second handle end. The first handle end comprises a longitudinally aligned rod-receiving cavity and a laterally aligned button-receiving cavity. The second handle end comprises a longitudinally aligned, substantially linear finger-engaging region and a rounded hand-protecting region. The finger-engaging region and the hand-protecting region are integrally formed with one another thus forming a hand-receiving aperture.

The connecting rod comprises a longitudinally aligned, substantially linear handle-engaging first rod end, a blade-receiving second rod end, and a rigid, substantially S-shaped angular bend. The angular bend is spatially located intermediate the first rod end and the second rod end. The first rod end comprises a longitudinally aligned button-engaging shaft, which shaft has a longitudinal shaft axis. The shaft is movably inserted in the rod-receiving cavity and comprises at least two button-receiving apertures. The button-receiving apertures each have a button-receiving axis, which axes are substantially orthogonal to the shaft axis. The second rod end comprises select blade attachment means.

The length-adjusting button is cooperatively received in the button-receiving cavity and selectively receivable in one of the button-receiving apertures for adjusting the effective length of the connecting rod. The present invention further provides a select shaving blade attachment, which shaving blade attachment comprises a shaving blade end and a rod-engaging end. The rod-engaging end is detachably received by the second rod end. The blade attachment means enable a user to selectively detach the select shaving blade attachment, which select shaving blade attachment enables a user to shave unwanted hair from body areas. The shaving system thus enables a user to shave hard to reach body areas.

It will be seen from a consideration of the following detailed descriptions and appended drawings that the present invention teaches a shaving system with an extendable handle and an angular bend whereby the handle may be extended by a connecting rod which fits inside said handle to a desired variable length, such as approximately 12 to 18 inches, to adjust to different body sizes and the rigid angular bend may be formed from a range of arc lengths subtended by a range of rotational degrees, the range being approximately 30–90 rotational degrees (0.526 radians–1.57 radians) to more properly conform to different body sizes. The select shaving blade attachment may be selected from the group consisting of a disposable straight razor blade assembly and an electric razor head assembly.

It is to be understood that both the foregoing general description and the following detailed description are exemplary and are intended to provide further explanation of the invention claimed.

The accompanying drawing figures, which are incorporated in and constitutes part of this specification, are included to illustrate and provide a further understanding of the present invention. Together with the description, the drawing figures serve to explain the principles of the invention.

DETAILED DESCRIPTION OF THE PREFERRED EMBODIMENT

Figure 1:
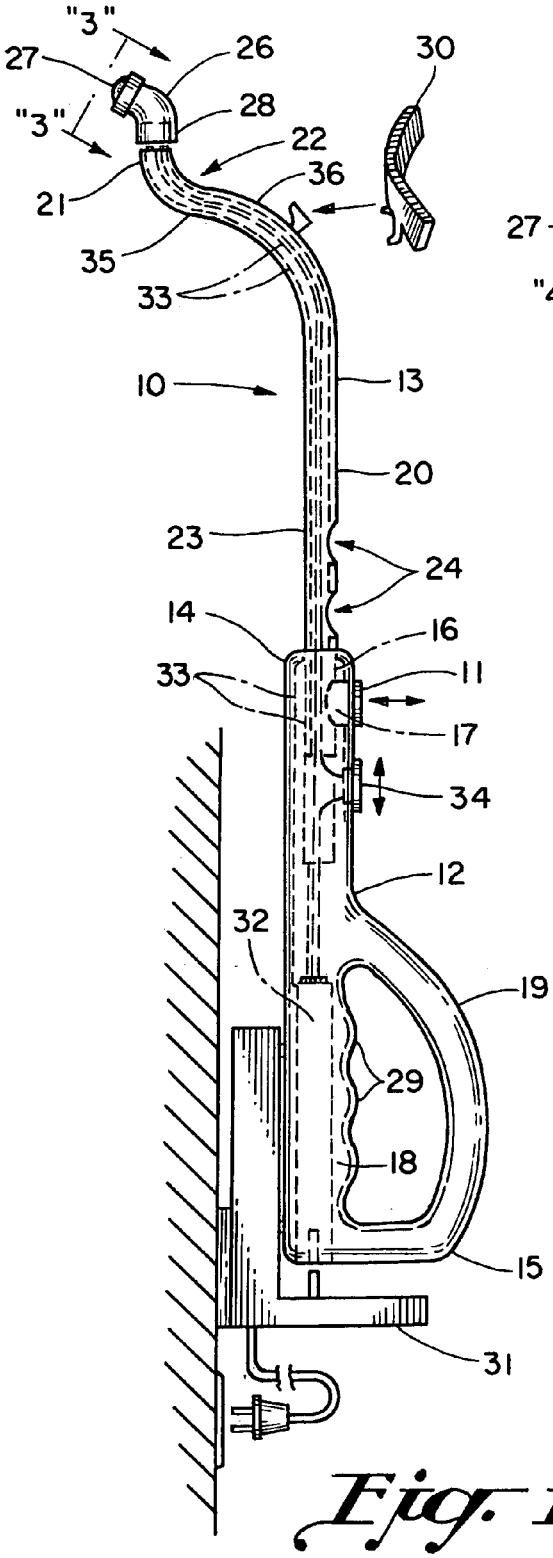
FIG. 1 is a side view of the preferred shaving system showing a power source-recharging base, an extendable handle assembly with a detachable electric razor head assembly and detachable shaving cream applicator, and electric circuitry shown in phantom.

References will now be made in detail to the present preferred embodiment of the present invention, examples of which have been illustrated in the accompanying drawing figures. The method and corresponding steps of the present invention will be described in conjunction with the detailed description of the shaving system.

The apparatuses and methods presented herein may be used to shave hard to reach body areas. For purposes of explanation and illustration, and not limitation, an exemplary embodiment of the shaving system, in accordance with the present invention is illustrated and referenced in FIGS. 1 and 2. As earlier indicated, the preferred shaving system is designed to enable a user to shave hard to reach body areas. The preferred shaving system thus comprises, in combination, an extendable handle assembly 10; a length-adjusting button 11, and a select shaving blade attachment. Assembly 10 and button 11 have been illustrated and specifically referenced in FIGS. 1 and 2.

Extendable handle assembly 10 preferably comprises a hand grip portion 12 and a connecting rod 13. Hand grip portion 10 preferably comprises a longitudinally aligned, substantially linear rod-receiving first handle end 14 and a ringed, hand-engaging second handle end 15. First handle end 14 preferably comprises a longitudinally aligned rod-receiving cavity 16 and a laterally aligned button-receiving cavity 17 as illustrated and referenced in FIG. 1. Second handle end 15 preferably comprises a longitudinally aligned, substantially linear finger-engaging region 18 and a rounded hand-protecting region 19 as illustrated and referenced in FIGS. 1 and 2. Finger-engaging region 18 and hand-protecting region 19 are preferably integrally formed with one another and together thus form a hand-receiving aperture, akin to the hilt of a traditional saber or sword. Finger-engaging region 18 may preferably be defined by comprising a plurality of finger nubs 29 as illustrated and referenced in FIGS. 1 and 2. It is contemplated that the inclusion of finger nubs may provide the user with additional grip support while shaving hard to reach body areas.

Figure 2:
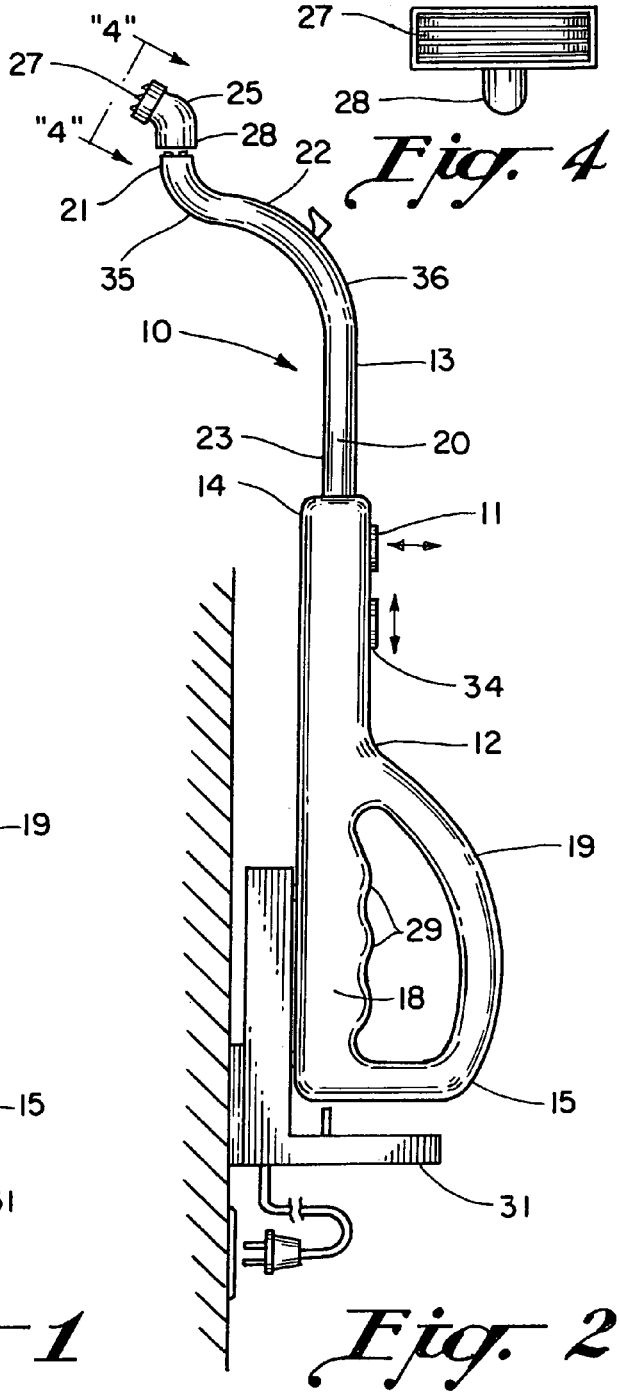
FIG. 2 is a side view of the preferred shaving system showing a power source-recharging base, an extendable handle assembly with a disposable straight razor head assembly.

Connecting rod 13 preferably comprises a longitudinally aligned, substantially linear handle-engaging first rod end 20, a blade-receiving second rod end 21, and a rigid, substantially S-shaped angular bend 22 as illustrated and referenced in FIGS. 1 and 2. It will be seen from an inspection of the noted figures that angular bend 22 is spatially located intermediate first rod end 20 and second rod end 21. Angular bend 22 preferably comprises first and second oppositely curved, continuous arc lengths 36 and 35, arc lengths 36 and 35 being subtended or selected from a degree range of about 0.523 radians to about 1.57 radians (arc lengths subtended by about 1.57 radians have been illustrated in FIGS. 1 and 2). It will be further seen that the first arc length 35 has a magnitude less than the second arc length 35. In this regard, it is contemplated that the preferred ratio of the radii of curvature respectively associated with first arc length 35 and second arc length 36 be about 0.375. In other words, it is contemplated that the preferred ratio of the radius of curvature for first arc length 35 to the radius of curvature for second arc length 35 is about 0.375. Thus, it will be understood that in the preferred embodiment, first arc length 35 is substantially lesser in magnitude than the second arc length 36.

First rod end 20 preferably comprises a longitudinally aligned button-engaging shaft 23 as further referenced in FIGS. 1 and 2. Shaft 23 thus comprises a longitudinal shaft axis. Shaft 23 is movably inserted in rod-receiving cavity 16 and preferably comprises at least two button-receiving apertures 24 as illustrated and referenced in FIG. 1. Button-receiving apertures 24 each have a button-receiving axis, which button-receiving axes are preferably substantially orthogonal to the shaft axis.

Figure 3:
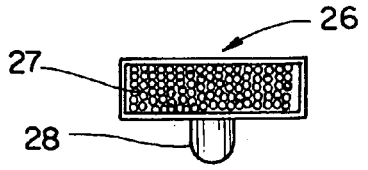
FIG. 3 is a frontal view of the electric razor head assembly shown in FIG. 1.
Figure 4:
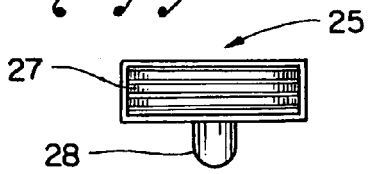
FIG. 4 is a frontal view of the disposable straight razor blade assembly shown in FIG. 2.

Connecting rod 13 preferably comprises a select exposed rod length, the select exposed length being selected from a range of about 12 to 18 inches. Length-adjusting button 11 is received in button-receiving cavity 17 and further selectively receivable in one of button-receiving apertures 24 for adjusting the effective length of connecting rod 13. The select shaving blade attachment may preferably be selected from the group consisting of a disposable straight razor blade assembly 25 as illustrated in FIGS. 2 and 4; and an electric razor head assembly 26 as illustrated in FIGS. 1 and 3. It will be seen from an inspection of the noted figures that each of the select shaving blade attachments preferably comprise a shaving blade end 27 and a rod-engaging end 28 as illustrated and referenced in FIGS. 1–4, inclusive. Rod-engaging ends 28 are detachably received by second rod end 21 and the blade attachment means enable a user to selectively detach the select shaving blade attachment. Second rod end 21 preferably comprises select blade attachment means (not specifically illustrated), which select blade attachment means function to selectively detach the select shaving blade attachment. It will be readily understood that the select shaving blade attachment enables a user to shave unwanted hair from body areas and the shaving system as thus specified enables a user to shave hard to reach body areas.

The shaving system may further preferably comprise a detachable shaving cream applicator 30 as illustrated and referenced in FIG. 1. Shaving cream applicator 30 is preferably detachably attached to angular bend 22 for enabling users to apply shaving cream, shaving lotion, and similar other shaving lubricants to the area to be shaved prior to shaving. Preferably, shaving cream applicator 30 is attachable to angular bend 22 adjacent second arc length 35 substantially as illustrated in FIGS. 1 and 2. It is contemplated that by placing shaving cream applicator 30 adjacent second arc length 35, shaving cream applicator will not otherwise interfere with the operation of the select shaving blade attachment during the shaving procedure.

The preferred shaving system may further preferably comprise a power source-recharging base 31 as illustrated in FIGS. 1 and 2. Further, extendable handle assembly 10 may further preferably comprise a rechargeable power source 32 and electric circuitry 33 as illustrated and referenced in phantom (broken lines) in FIG. 1. Electric circuitry 33 preferably comprises switch means 34, which is preferably located adjacent length-adjusting button 11 as illustrated and referenced in FIGS. 1 and 2. Rechargeable power source 32 is rechargeable by placing the same on power source-recharging base 31 and electric circuitry 33 provides electrical communication between switch means 34, rechargeable power source 32 and electric razor head assembly 26. Rechargeable power source 32 and electric circuitry 33 thus function to selectively and electrically operate electric razor head assembly 26.

METHOD

The present invention thus further contemplates a method of shaving hard to reach body areas, the method essentially comprising the steps of: (1) providing an extendable handle shaving system or extendable handle shaving assembly 10 substantially as described hereinabove for enabling a user to shave hard to reach body areas, such as one's back; (2) adjusting the effective length of connecting rod 13 to a desired length via length-adjusting button 11; and (3) shaving a desired hard to reach body area via the select shaving blade attachment. The step of adjusting the effective length of connecting rod 13 to a desired length via length-adjusting button 11 may preferably be defined by adjusting the effective length of the connecting rod to a select exposed rod length. As described above, the select exposed rod length is preferably selected from an approximate measured range of 12 to 18 inches.

Additionally, as earlier described, the shaving system or extendable handle assembly 10 may comprise detachable shaving cream applicator 30. Should shaving cream applicator 30 be detachably attached to angular bend 22, the method may comprise an additional step of applying shaving cream to the desired hard to reach body area after the step of adjusting the effective length of connecting rod 13 to a desired length and before the step of shaving the desired hard to reach body area.

While the above description contains much specificity, this specificity should not be construed as limitations on the scope of the invention, but rather as an exemplification of the invention. For example, it is contemplated that the spirit of the present invention is practiced when the shaving system is broadly described by comprising an extendable handle assembly and a select shaving blade attachment. The extendable handle assembly essentially comprises a hand grip portion and a connecting rod. The hand grip portion essentially comprising a longitudinally aligned, substantially linear rod-receiving first handle end and a ringed, hand-engaging second handle end. The first handle end essentially comprises a longitudinally aligned rod-receiving cavity and a laterally aligned adjustment means-receiving cavity. The second handle end essentially comprises a longitudinally aligned, substantially linear finger-engaging region and a rounded hand-protecting region. The finger-engaging region and the hand-protecting region are integrally formed with one another thus forming a hand-receiving aperture. The connecting rod essentially comprises a longitudinally aligned, substantially linear handle-engaging first rod end, a blade-receiving second rod end, and a substantially S-shaped angular bend intermediate the first rod end and the second rod end. The first rod end essentially comprises a longitudinally aligned shaft, which shaft has a longitudinal shaft axis. The shaft is movably inserted in the rod-receiving cavity and essentially comprises shaft length-adjusting means. The shaft length-adjusting means are cooperatively associated with the adjustment means-receiving cavity for adjusting the effective length of the connecting rod. The second rod end comprises blade attachment means.

The select shaving blade attachment essentially comprises a shaving blade end and a rod-engaging end. The rod-engaging end is detachably received by the second rod end and the blade attachment means enable a user to selectively detach the select shaving blade attachment. The select shaving blade attachment thus enables a user to shave unwanted hair from body areas, and the shaving system, as thus described, enables a user to shave hard to reach body areas.

Accordingly, although the invention has been described by reference to a preferred embodiment, it is not intended that the novel assembly be limited thereby, but that modifications thereof are intended to be included as falling within the broad scope and spirit of the foregoing disclosure, the following claims and the appended drawings.

We claim:

1. An extendable handle shaving system for enabling a user to shave hard to reach body areas, the extendable handle shaving system comprising:

an extendable handle assembly, the extendable handle assembly comprising a hand grip portion and a connecting rod, the hand grip portion comprising a longitudinally aligned, substantially linear rod-receiving first handle end and a ringed, hand-engaging second handle end, the first handle end comprising a longitudinally aligned rod-receiving cavity and a laterally aligned button-receiving cavity, the second handle end comprising a longitudinally aligned, substantially linear finger-engaging region and a rounded hand-protecting region, the finger-engaging region and the hand-protecting region integrally formed with one another thus forming a hand-receiving aperture, the connecting rod comprising a longitudinally aligned, substantially linear handle-engaging first rod end, a blade-receiving second rod end, and a rigid, substantially S-shaped angular bend, the angular bend being spatially located intermediate the first rod end and the second rod end, the first rod end comprising a longitudinally aligned button-engaging shaft, the shaft having a longitudinal shaft axis, the shaft being movably inserted in the rod-receiving cavity, the shaft comprising at least two button-receiving apertures, the button-receiving apertures each having a button-receiving axis, the button axes being substantially orthogonal to the shaft axis, the second rod end comprising select blade attachment means;

a length-adjusting button, the length-adjusting button being received in the button-receiving cavity, the length-adjusting button being selectively receivable in one of the button-receiving apertures for adjusting the effective length of the connecting rod; and a select shaving blade attachment, the shaving blade attachment comprising a shaving blade end and a rod-engaging end, the rod-engaging end being detachably received by the second rod end, the select blade attachment means enabling a user to selectively detach the select shaving blade attachment, the select shaving blade attachment enabling a user to shave unwanted hair from body areas, the extendable handle shaving system thus enabling a user to shave hard to reach body areas.

2. The extendable handle shaving system of claim 1 wherein the extendable handle shaving system comprises a detachable shaving cream applicator, the shaving cream applicator being detachably attached to the angular bend.

3. The extendable handle shaving system of claim 1 wherein the angular bend comprises first and second arc lengths, the first and second arc lengths each being subtended from a degree range of about 0.523 radians to about 1.57 radians.

4. The extendable handle shaving assembly of claim 3 wherein the first arc length has a magnitude less than the second arc length.

5. The extendable handle shaving assembly of claim 4 wherein the first arc length comprises a first radius of curvature and the second arc length comprises a second radius of curvature, the ratio of the first radius of curvature to the second radius of curvature being about 0.375.

6. The extendable handle shaving system of claim 1 wherein the connecting rod comprises a select exposed rod length, the select exposed length being selected from a range of 12 to 18 inches.

7. The extendable handle shaving system of claim 1 wherein the select shaving blade attachment is selected from the group consisting of a disposable straight razor blade assembly and an electric razor head assembly.

8. The extendable handle shaving system of claim 8 wherein the extendable handle shaving system comprises a power source-recharging base and the extendable handle assembly comprises a rechargeable power source and electric circuitry, the rechargeable power source and electric circuitry for selectively and electrically operating the electric razor head assembly.

9. A shaving system for enabling a user to shave hard to reach body areas, the shaving system comprising:

an extendable handle assembly, the extendable handle assembly comprising a hand grip portion and a connecting rod, the hand grip portion comprising a longitudinally aligned, substantially linear rod-receiving first handle end and a ringed, hand-engaging second handle end, the first handle end comprising a longitudinally aligned rod-receiving cavity and a laterally aligned adjustment means-receiving cavity, the second handle end comprising a longitudinally aligned, substantially linear finger-engaging region and a rounded hand-protecting region, the finger-engaging region and the hand-protecting region integrally formed with one another thus forming a hand-receiving aperture, the connecting rod comprising a longitudinally aligned, substantially linear handle-engaging first rod end, a blade-receiving second rod end, and a substantially S-shaped angular bend, the angular bend being spatially located intermediate the first rod end and the second rod end, the first rod end comprising a longitudinally aligned shaft, the shaft having a longitudinal shaft axis, the shaft being movably inserted in the rod-receiving cavity, the shaft comprising shaft length-adjusting means, the shaft length-adjusting means being cooperatively associated with the adjustment means-receiving cavity for adjusting the effective length of the connecting rod, the second rod end comprising select blade attachment means; and a select shaving blade attachment, the shaving blade attachment comprising a shaving blade end and a rod-engaging end, the rod-engaging end being detachably received by the second rod end, the select blade attachment means enabling a user to selectively detach the select shaving blade attachment, the select shaving blade attachment enabling a user to shave unwanted hair from body areas, the shaving system thus enabling a user to shave hard to reach body areas.

10. The shaving system of claim 9 wherein the shaving system comprises a detachable shaving cream applicator, the shaving cream applicator being detachably attached to the angular bend.

11. The shaving system of claim 9 wherein the angular bend comprises first and second arc lengths, the first and second arc lengths each being subtended from a degree range of about 0.523 radians to about 1.57 radians.

12. The shaving assembly of claim 11 wherein the first arc length has a magnitude less than the second arc length.

13. The shaving assembly of claim 12 wherein the first arc length comprises a first radius of curvature and the second arc length comprises a second radius of curvature, the ratio of the first radius of curvature to the second radius of curvature being about 0.375.

14. The shaving system of claim 9 wherein the connecting rod comprises a select exposed rod length, the select exposed length being selected from a range of 12 to 18 inches.

15. The shaving system of claim 9 wherein the select shaving blade attachment is selected from the group consisting of a disposable straight razor blade assembly and an electric razor head assembly.

16. The shaving system of claim 15 wherein the shaving system comprises a power source-recharging base and the extendable handle assembly comprises a rechargeable power source and electric circuitry, the rechargeable power source and electric circuitry for selectively and electrically operating the electric razor head assembly.

17. A method of shaving hard to reach body areas, the method comprising the steps of:

providing a shaving system for enabling a user to shave hard to reach body areas, the shaving system comprising:

an extendable handle assembly, the extendable handle assembly comprising a hand grip portion and a connecting rod, the hand grip portion comprising a longitudinally aligned, substantially linear rod-receiving first handle end and a ringed, hand-engaging second handle end, the first handle end comprising a longitudinally aligned rod-receiving cavity and a laterally aligned adjustment means-receiving cavity, the second handle end comprising a longitudinally aligned, substantially linear finger-engaging region and a rounded hand-protecting region, the finger-engaging region and the hand-protecting region integrally formed with one another thus forming a hand-receiving aperture, the connecting rod comprising a longitudinally aligned, substantially linear handle-engaging first rod end, a blade-receiving second rod end, and a substantially S-shaped angular bend, the angular bend being spatially located intermediate the first rod end and the second rod end, the first rod end comprising a longitudinally aligned shaft, the shaft having a longitudinal shaft axis, the shaft being movably inserted in the rod-receiving cavity, the shaft comprising length-adjusting means, the length-adjusting means being cooperatively associated with the adjustment means-receiving cavity for adjusting the effective length of the connecting rod, the second rod end comprising blade attachment means; and a select shaving blade attachment, the shaving blade attachment comprising a shaving blade end and a rod-engaging end, the rod-engaging end being detachably received by the second rod end, the blade attachment means enabling a user to selectively detach the select shaving blade attachment, the select shaving blade attachment enabling a user to shave unwanted hair from body areas;

adjusting the effective length of the connecting rod to a desired length via the length-adjusting means; and shaving a desired hard to reach body area via the select shaving blade attachment.

18. The method of claim 17 wherein the step of adjusting the effective length of the connecting rod is defined by adjusting the effective length of the connecting rod to a select exposed rod length, the select exposed rod length being selected from a range of 12 to 18 inches.

19. The method of claim 18 wherein the shaving system comprises a detachable shaving cream applicator, the shaving cream applicator being detachably attached to the angular bend, the method comprising an additional step of applying shaving cream to the desired hard to reach body area after the step of adjusting the effective length of the connecting rod and before the step of shaving the desired hard to reach body area.

20. The method of claim 17 wherein the select shaving blade attachment is selected from the group consisting of a disposable straight razor blade assembly and an electric razor head assembly.

21. The method of claim 20 wherein the shaving system comprises a power source-recharging base and the extendable handle assembly comprises a rechargeable power source and electric circuitry, the rechargeable power source and electric circuitry for selectively and electrically operating the electric razor head assembly.

* * * * *